United States Patent [19]

Pastva

[11] Patent Number: 4,844,523

[45] Date of Patent: Jul. 4, 1989

[54] DOOR CONTROL MECHANISM

[75] Inventor: John V. Pastva, Parma Heights, Ohio

[73] Assignee: The Eastern Company, Cleveland, Ohio

[21] Appl. No.: 121,892

[22] Filed: Nov. 17, 1987

[51] Int. Cl.[4] ..... E05C 9/08

[52] U.S. Cl. ..... 292/218

[58] Field of Search ..... 292/218, 190, 240, 241, 292/242, 194

[56] References Cited

U.S. PATENT DOCUMENTS

| | | | |
|---|---|---|---|
| D. 250,247 | 11/1978 | Pastva | 8/339 |
| 1,720,173 | 7/1929 | Fushs . | |
| 1,952,112 | 3/1934 | Bartsch | 292/218 |
| 1,988,585 | 1/1935 | Dath . | |
| 2,186,903 | 1/1940 | Gleason | 292/254 |
| 2,236,391 | 3/1941 | Zabel | 292/173 |
| 2,301,444 | 11/1942 | Olander | 292/218 |
| 2,451,537 | 10/1948 | Dath | 292/218 |
| 2,764,443 | 9/1956 | Bennett | 292/240 |
| 2,861,830 | 11/1958 | Bennett | 292/240 |
| 3,099,473 | 7/1963 | Pastva, Jr. | 292/240 |
| 3,134,618 | 5/1964 | Heimann | 292/240 |
| 3,160,433 | 12/1964 | Schieger et al. | 292/241 |
| 3,188,128 | 6/1965 | Olander | 292/240 |
| 3,212,805 | 10/1965 | Olander | 292/218 |
| 3,281,177 | 10/1966 | Tenenbaum | 292/241 |
| 3,329,456 | 7/1967 | Olander | 292/218 |
| 3,451,705 | 6/1969 | Turpen | 292/218 |
| 3,484,127 | 12/1969 | Pastva | 292/218 |
| 3,544,145 | 12/1970 | Cerutti | 292/54 |
| 3,572,794 | 3/1971 | Pastva | 292/218 |
| 3,661,412 | 5/1972 | Morris | 292/218 |
| 3,664,695 | 5/1972 | Sickel | 292/54 |
| 3,695,661 | 10/1972 | Pastva | 292/218 |
| 3,756,671 | 9/1973 | White | 292/218 |
| 3,784,243 | 1/1974 | Pastva, Jr. | 292/300 |
| 3,801,146 | 4/1974 | Donath et al. | 292/218 |
| 3,912,312 | 10/1975 | Cerutti | 292/218 |
| 4,029,349 | 6/1977 | Sweda et al. | 292/241 |
| 4,087,122 | 5/1978 | Shaw et al. | 292/218 |
| 4,127,291 | 11/1978 | Pelcin | 292/54 |
| 4,146,257 | 3/1979 | Pastva | 292/218 |
| 4,235,463 | 11/1988 | Benevenuta | 292/218 |
| 4,483,557 | 11/1984 | Pastva | 292/218 |
| 4,601,501 | 7/1986 | Pastva | 292/218 |

FOREIGN PATENT DOCUMENTS

| | | |
|---|---|---|
| 470542 | 1/1951 | Canada . |
| 713292 | 7/1965 | Canada . |
| 1927476 | 12/1970 | Fed. Rep. of Germany . |
| 2248356 | 4/1973 | Fed. Rep. of Germany . |
| 2510554 | 10/1975 | Fed. Rep. of Germany . |

*Primary Examiner*—Richard E. Moore

*Attorney, Agent, or Firm*—Watts, Hoffmann Fisher & Heinke

[57] ABSTRACT

A door control mechanism for use with a pivoted door and associated frame in a truck trailer. The door control mechanism comprised of cam latch members on opposite ends of a rotatable shaft connected to a pivoted door by bearing members, and keeper members secured to the door frame adjacent edges of the door that are transverse to the pivotal axis of the door. Rotation of the shaft about its longitudinal axis engages and disengages the cam and keeper members. The cam members include a body portion having a forked tine portion projecting from one side of the body, and a single tine portion with an inclined side surface projecting opposite therefrom. The keeper members include a base portion having a post projecting from the base for receiving the forked portion of the cam, and a post having an inclined side wall and cam latch retaining member for receiving the single tine portion of the cam.

6 Claims, 3 Drawing Sheets

FIG. 3
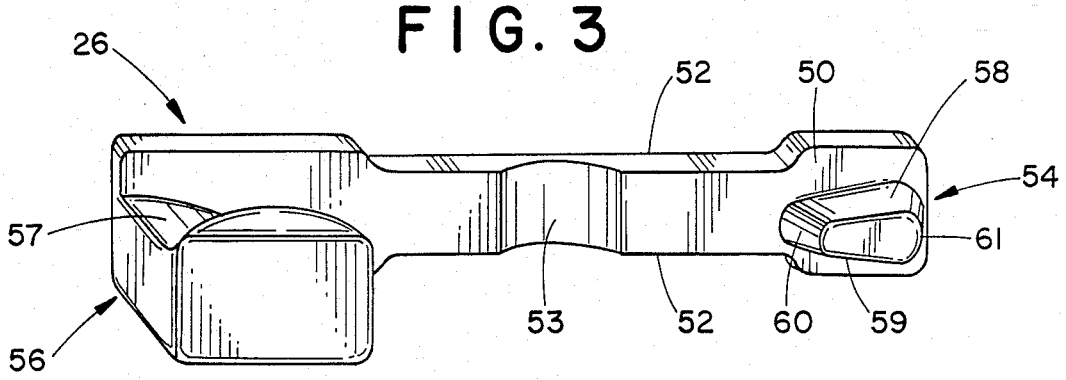
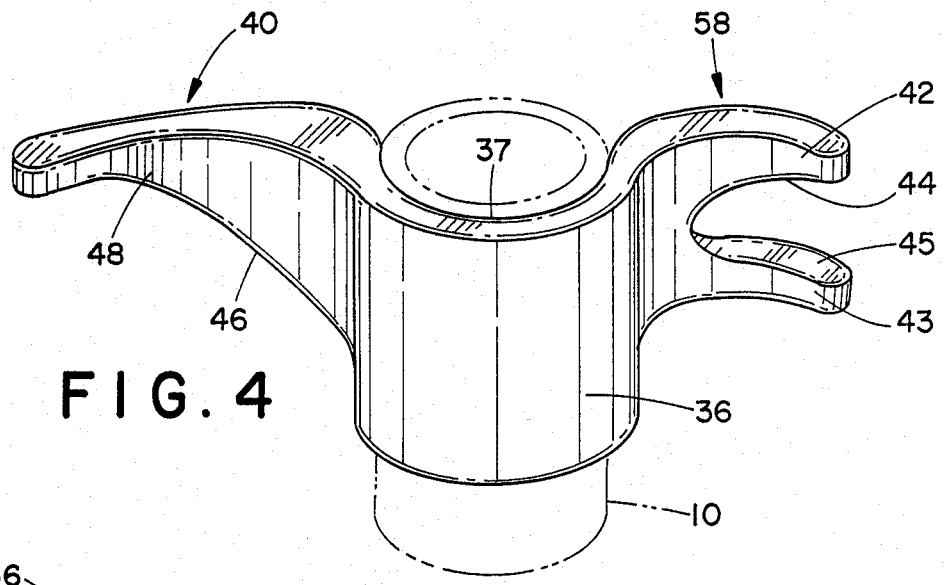
FIG. 4
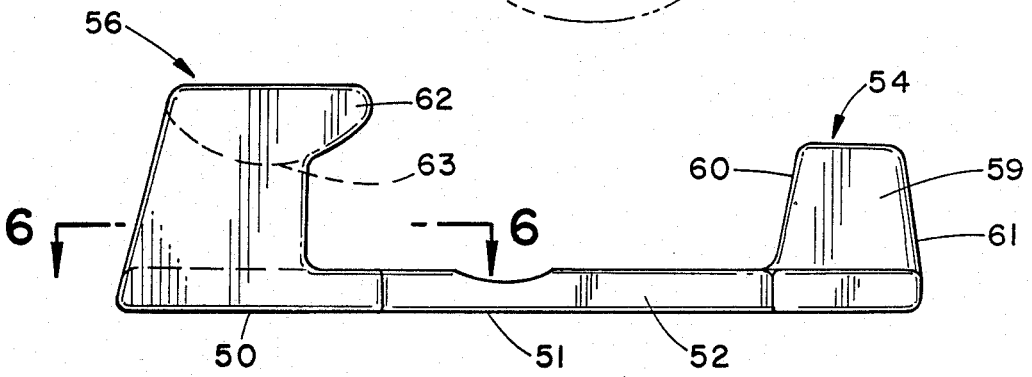
FIG. 5
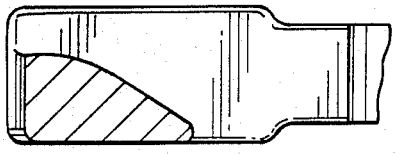
FIG. 6

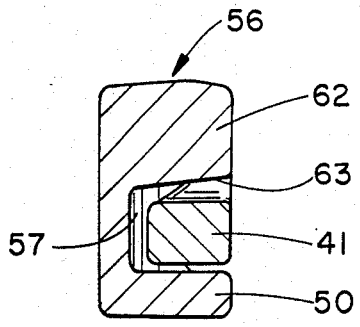
FIG. 10
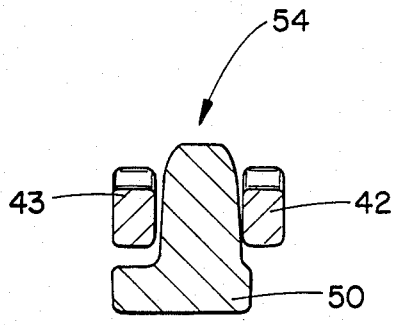
FIG. 11
FIG. 8
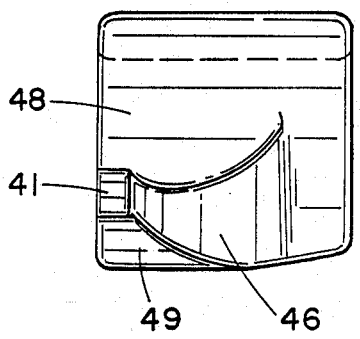
FIG. 9
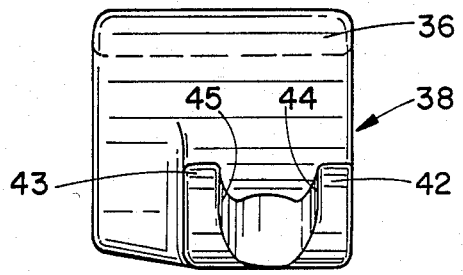
FIG. 7
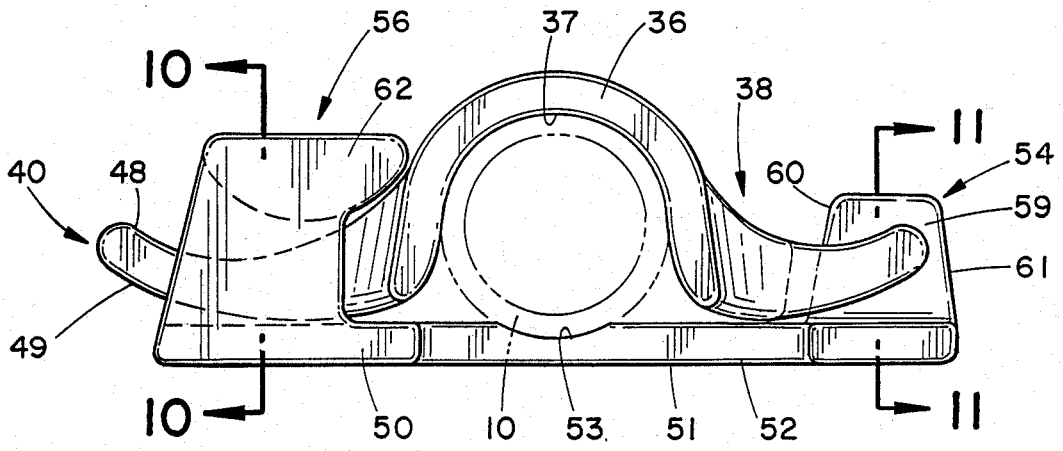

DOOR CONTROL MECHANISM

TECHNICAL FIELD

The present invention relates to a door control mechanism of the type having a latch and keeper for latching and maintaining pivoted doors, and particularly for correcting alignment of large pivoted doors of trucks, trailers and/or large cargo containers, in their associated door frames and the like.

BACKGROUND ART

Truck and trailer bodies and large shipping containers typically utilize pivoted doors at one end wall to facilitate loading and unloading of the containers. Various door control mechanisms are used with such doors for latching and maintaining the doors in a closed position and to reduce or eliminate the transverse distortion, or racking, in the trailer bodies and cargo containers.

In the past, these mechanisms have included one or more shafts or lock rods which extend the height of the door and have latching cam members at each end which are engageable with keeper members on the door frame. Anti-rack mechanisms of this type are typically provided with cam members that extend laterally from opposite sides of the lock rod for latching the doors, aligning the doors relative to the door frame and resisting racking. Constructions of this type are illustrated in U.S. Pat. Nos. 3,099,473, 3,484,128 and 3,695,661. The cam members disclosed include forked portions and cam surfaces engageable with opposite portions of the keeper member.

Prior mechanisms of this type have sometimes been provided with latch members that are universal so that only one cam and keeper need be manufactured for use at either end of the shaft and on doors pivoted at either side of the frame.

As the size of truck trailers and cargo containers has increased, a combination of changes has been made in the configuration of trailers and containers, including greater trailer length and larger door openings. Enlargement of the door openings has been achieved by narrowing the associated door frames housing the doors. One problem with the enlarged sizes of the trailers and doors has been the increased racking effect on the containers. The reduced size of door frames has also reduced the surface area of the frame which is available for attachment of the keeper members. This in turn has diminished the vertical height available for the cams and keepers and has thereby limited the amount of door misalignment that can be corrected by the inclined camming surfaces of the latch members, particularly because any one cam surface extended only a small portion of the cam height.

DISCLOSURE OF THE INVENTION

The present invention provides a new and improved door control mechanism having a cam configuration for aligning pivoted truck, trailer or container doors with their associated door frames during closing and an anti-rack configuration for resisting frame distortion when the doors are closed.

The mechanism includes a shaft with a vertical axis of rotation rotatably connected to a swinging door by bearing members. The shaft includes means for rotating the shaft about its longitudinal axis and cam members secured to opposite ends of the shaft. Keeper members are secured to structure adjacent edge portions of the swinging door and are cooperable with the cam members when the shaft is rotated to engage the keeper members for latching the door. Cooperation between the cam and keeper members forces the door into alignment during latching and maintains alignment of the door once it is secured in the latched position.

The new and improved cam of this invention projects in opposite directions on both sides of the shaft. One projecting portion is forked and the other is a single tine or prong having an inclined side surface along its length. Spaced projections of the keeper are engaged by the cam portions. By virtue of the single tine structure and cooperating keeper portion, the alignment of swinging doors may be corrected in the vertical direction in an amount at least as great as the height of the cam projection; i.e., of the single tine —basically twice the amount possible with a forked cam.

The keeper has two spaced portions projecting outwardly from a base portion. The base portion is of a narrow construction for attachment to a narrow door frame. One of the projections is a post which has side surfaces converging toward the other projection, and another projection is a post which has an inclined wall for camming engagement with the inclined single-tine latch surface. A retaining flange extends laterally from the post that has the inclined wall and overhangs the inclined wall. The single projecting tine of the cam and the inclined wall of the keeper portion cooperate to shift the door during rotation of the cam into latching or closed position if the door is misaligned and the retaining flange acts as a fulcrum for the cam.

During the normal latching procedure, each of the cam portions is cooperable with the spaced portions projecting from the keeper. As the shaft and cam are rotated, the single tine cam projections initiate engagement with the inclined surface of the keeper projections and with the retaining flange. As rotation continues, the cam and keeper members cooperate to shift the associated door relative to the frame into alignment within the frame. When the shaft is fully rotated to the closed position, the cam members are captured within cooperating keeper members and thus inhibit relative shifting of the door and frame out of alignment.

BRIEF DESCRIPTION OF THE DRAWINGS

FIG. 3 is a perspective view of a keeper embodying the present invention;

FIG. 4 is a perspective view of a cam embodying the present invention;

FIG. 5 is a side elevational view of a keeper embodying the present invention;

FIG. 6 is a sectional view of the keeper along the line 6—6 of FIG. 5;

FIG. 7 is a sectional view of the cam and keeper combination taken along the line 7—7 of FIG. 2;

FIG. 8 is a side elevational view of the cam embodying the present invention;

FIG. 9 is a side elevational view of the cam embodying the present invention;

FIG. 10 is a sectional view taken along the line 10—10 of FiG. 7; and FIG. 11 is a sectional view taken along the line 11—11 of FIG. 7.

BEST MODE FOR CARRYING OUT THE INVENTION

Figure 1:
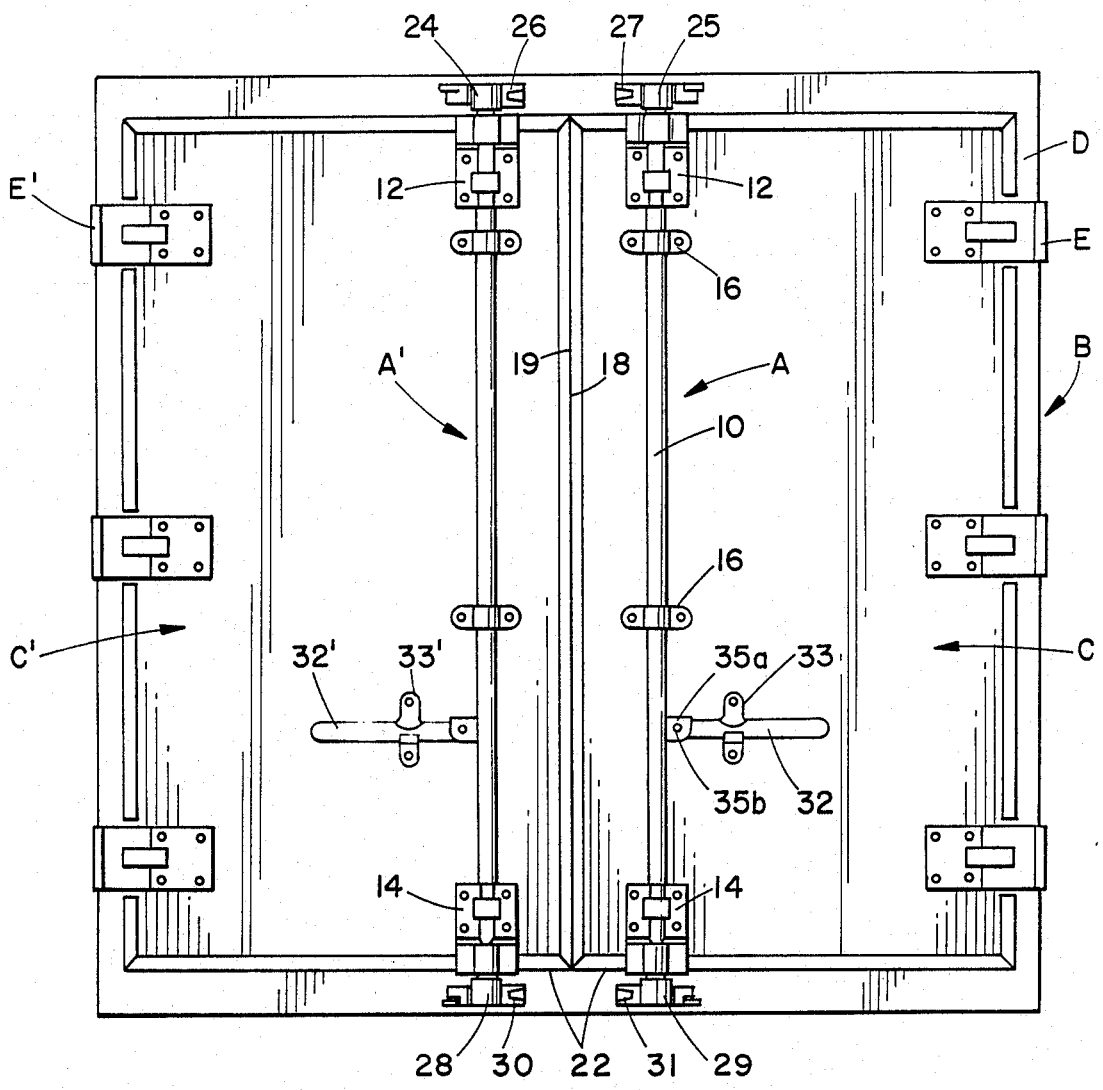
FIG. 1 is a partial elevational view of the back end of a truck trailer or container having double access doors equipped with a preferred embodiment of the present invention.

The preferred door control mechanism, designated generally by the reference character A, is shown in FIG. 1 applied to a truck body B having pivoted rear flush-type double access doors C, C', secured to the door frame D by hinges E along opposite vertical edges. In the usual fashion, there is a second door control mechanism A' on the door C'. Since both are basically identical, but oppositely facing, only the mechanism A will be described in detail.

The door control mechanism A includes a pivotable shaft or lock rod 10 rotatably supported along the outside surface of the door C, by a plurality of suitable upper and lower bearing members or brackets 12, 14 and intermediate bearing members or brackets 16 that pivotably secure the shaft 10 to the door for movement about the longitudinal axis of the rod which is adjacent to the non-pivoted edge 18 of the door C, C'. The ends of the shaft 10 extend above the upper edge 20 of the door and below the lower edge 22, and have upper and lower cam latch members 25, 29 attached thereto which cooperate with upper and lower keeper structures 27, 31 secured to the door frame D. The cam and keeper members are positioned for cooperating engagement when the door is being closed. Once the door is in a closed position the members serve to maintain the door C, in a closed and aligned position relative to the door frame D. A handle 32 is pivotably secured to and extends laterally from a bracket secured to the shaft 10 for oscillating the shaft and thereupon pivoting the cam members 25, 29 into and out of engagement with the keepers 27, 31. A conventional handle retainer assembly 33 is attached to door C, to secure the handle in a fixed position relative to the door.

The symmetrical relationship between the pairs of upper and lower cam latch and keeper members located on the right and left-hand doors C, C', is such that only two types of cam and keeper member parts are required. One of these configurations is mounted right side up on the upper frame of the left-hand door C', and upside down on the lower frame of the right-hand door C. The second configuration is mounted right side up on the upper frame of the right-hand door C, and upside down on the lower frame of the left-hand door C'. Thus the pairs of cam latch and keeper members 24, 26 and 28, 30 on the left door C' are mirror image assemblies of the members 25, 27 and 29, 31 on the right door C, and the upper members 24, 26, and 25, 27 are mirror images of the lower members 28, 30, and 29, 31. Because of this symmetrical relationship only the cam latch 25 and keeper 27 will be described in detail.

As shown in FIGS. 2, 4 and 7–9, the cam latch member 25 includes a central U-shaped body portion 36 partially surrounding the end of the shaft 10 which extends above the upper edge 20 of door C, and two portions 38, 40 projecting transversely of the shaft in generally opposite directions. In the preferred embodiment, the shaft is cylindrical in shape for engagement with the central portion 36 of the cam member which is adapted to include a semi-cylindrical recess 37 that extends the length of the body portion to receive the shaft 10.

Figure 2:
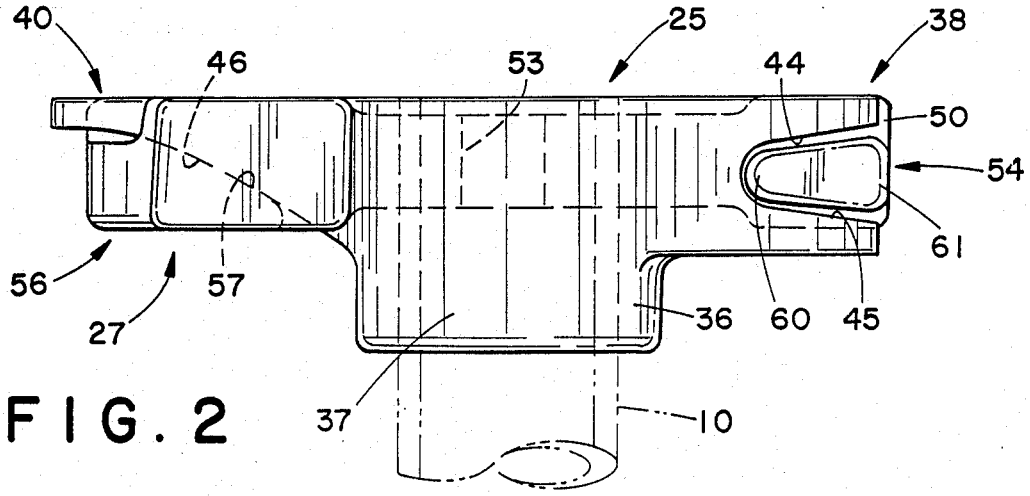
FIG. 2 is an enlarged view of the cam and keeper combination as shown in FIG. 1 in the latched position.

As shown in FIGS. 2 and 4 specifically, one projecting portion 38 extending from the U-shaped body portion 36 is forked and includes fork projections or tines 42, 43 which define a V-shaped groove and further include camming surfaces 44, 45 converging in a direction toward the U-shaped body portion 37. The tines of the first projecting portion 38, as shown in FIGS. 4 and 7, are curved in a direction away from the door C.

The second projecting portion 40, shown in FIG. 8, comprises a single tine 41 with an inclined side surface 46 beginning at the U-shaped body portion 36 and continuing in a direction away from the body portion along the length of the single tine 41. The second portion 40 is also curved in a direction away from the door C to provide corresponding concave and convex camming surfaces 48, 49 on the front and back of the tine 41 respectively. The curvature of the single tine projection 41 provides for additional cooperation of the cam member 25 with the keeper member 27 (and specifically with the retaining flange 62) during engagement of members 25, 27 as the door C is closed.

As shown in FIGS. 2, 3, 5 and 7, the keeper member 27 includes a narrow base portion 50 with a flat bottom surface 51 for abutting the door frame B above and adjacent to the upper edge 20 of door C in alignment with and opposite from the associated cam member 25. Two spaced portions 54, 56 project outwardly from the base portion 50 of the keeper 27. A channel portion 53 parallel with the axis of shaft 10, is also provided in the base portion 50 for engagement with the shaft 10 when the door C is in the closed position. In the preferred embodiment, the keeper members are welded to the door frame along recesses 52 located at edges of the base portion 50 which are substantially parallel with the upper edge 20 of the door C. The use of a narrow base portion and recesses 52 to accommodate the weld, allows the keeper member 26 to be used on trailers and containers having narrow door frames. The keeper members may alternatively be provided with apertures to facilitate attachment of the base 50 to the door frame D with fasteners.

One spaced portion 54 comprises a post including opposite side surfaces 58, 59, a surface 60 facing the second spaced portion 56, and a surface 61 facing away from the second spaced portion 56. All of the surfaces 58, 59, 60, 61 converge in a direction away from the base portion 50. Surfaces 58 and 59 also converge toward surface 60 and at substantially the same angle as the converged camming surfaces 44, 45 respectively. When the cam member 25 engages keeper member 27, the camming surfaces 44, 45 of the projecting portion 38 engage the opposite side surfaces 58, 59 of the spaced post portion 54 as shown in FIG. 11.

The second spaced portion 56 includes a post projecting from the base 50 having an inclined wall 57 to cammingly engage the inclined side surface 46 of the cam member 40, and a latch retaining flange 62 extending laterally from the post overhanging the inclined wall 57. The flange 62 preferably includes a convex camming surface 63 spaced from and facing the base portion 50 with a radius of curvature substantially equal to the radius of curvature of the concave cam member surface 48.

In the preferred embodiment shown in FIG. 1, the handle 32 is an elongated, flat, metal piece pivoted at one end to a handle bracket **35*a* by a pivot pin 35*b* extending through apertures in the handle bracket and handle 32. The bracket 35*a* is U-shaped to extend over an upper edge of the handle piece and on two sides thereof. The bracket is welded to the shaft for transmitting movement from the handle to the shaft. Clearance is provided between the handle and bracket to permit limited pivoting of the handle about the pin. Thus the handle can be moved a slight distance in a vertical plane to release it from the handle retaining assembly without moving the shaft 10**. Movement of the handle toward or away from the door turns the shaft about its longitudinal axis and rotates the associated upper and lower cam and keeper members.

During the opening operation of the door control mechanism A the handle 32 is rotated away from the door C, thereby correspondingly rotating the shaft 10 and attached upper and lower latch members 25, 29 in a clockwise direction. To close the door C, the door is moved into engagement with the associated door frame D. The handle 32 is then rotated towards the door C, rotating the shaft 10 and cam members 25, 29 in the counterclockwise direction such that the single tine projection 41 of the second projecting portion 40 engages the keeper member 27. Depending on the degree of alignment or misalignment of the door C with respect to the door frame D, the tine 41 engages the keeper member 27 along the convex camming surface 63 of the flange 62 or the inclined wall 57 of the second space portion 56. As the handle 32 is continually rotated, the single tine 41 cams into engagement with the second spaced portion 56 along either the concave camming surface 48, the convex camming surface 49 or the inclinded side surface 46, until the door C reaches the closed position. By using a single tine structure 41 and cooperating keeper portion 56, the alignment of the door C may be corrected as the door moves between open and closed positions, and maintained against racking of the door within the frame once the cams and keepers are engaged. Because the inclined surface 46 of the single tine portion 41 is engagable along the entire surface of the inclined wall 57, the cam and keeper members 25, 27, 29, 31 of door control mechanism A correct alignment of the door in the vertical direction by an amount at least as great as the height of the inclined wall 57. The corresponding capability of other cam and keeper members, such as the commercial embodiment of the universal structures disclosed in U.S. Pat. No. 4,601,501 only allow correction of door misalignment by an amount equal to half of the vertical height of the projecting portions.

The relationship between the cam projecting portions 38, 40 and the keeper spaced portions 54, 56 brings the door C into alignment with the door frame D when the door is moved to the closed position. Once the door is in the closed position the cam and keeper portions resist racking of the frame D by resisting relative twisting between the cam latch member 25 and keeper member 27. The manner in which the cam latch member 25 and keeper member 27 are engaged to resist racking when the door C is in the closed position is illustrated in FIGS. 2, 7, 10 and 11.

While A preferred embodiment of this invention has been described in detail, it will be apparent that certain modifications or alterations can be made therein without departing from the spirit and scope of the invention set forth in the appended claims.

I claim:

1. A door control mechanism of the type used to latch a pivoted door in a closed position, comprising:

(a) a keeper member adapted to be secured to a door frame adjacent an edge portion that extends transversely to the pivot axis of a pivoted door;

(b) a shaft adapted to be secured to such a door with its longitudinal axis spaced from and parallel with the pivot axis of the door;

(c) a latch member secured to an end of said shaft and cooperable with said keeper member for securing the door to which the shaft may be attached in a closed position;

(d) means for securing said shaft to the door so that the shaft can turn about its longitudinal axis;

(e) means connected to the shaft for turning it about said axis;

(f) said latch member having a U-shaped body portion partly surrounding the end of said shaft to which it is attached and having first and second portions projecting in generally opposite directions transversely of said shaft;

(g) each projecting portion being of substantially equal height in the longitudinal direction of the shaft and each having a surface for engaging said keeper memer, said first portion being forked for engagement with said keeper member, and said second portion being a single tine, curved and having its said surface inclined along its projecting length relative to the longitudinal axis of the shaft and extending substantially the full height of the projection in the axial direction a distance at least as great as the height of said first projecting portion; and (h) said keeper member having a base portion for attachment to a door frame or the like and first and second spaced portions extending outwardly from the base portion and constructed and arranged to be engaged by the projecting portions of the associated latch member during latching of said pivoted doors;

(i) said first spaced portion being a post constructed to be straddled and engaged by said forked first projecting portion and said second spaced portion having an inclined side wall adapted to engage said incline and having a latch member retaining wall extending laterally from the inclined side wall of said spaced portion and spaced from the base portion to engage said second latch member projecting portion;

(j) said second projecting latch member portion and said inclined side wall serving to correct alignment of the door and the frame as the latch and keeper members engage during operation of the mechanism and said first projecting latch member portion and said post serving to inhibit relative shifting of the door and the frame in the plane of the door when the latch and keeper members are engaged.

2. A cam latch for a door control mechanism of the type used to latch a pivoted door in a closed portion in an associated door frame or the like, said latch comprising a body portion for attachment to a pivoted shaft and first and second portions extending in generally opposite directions from said body portion, said first portion having two generally oppositely facing surfaces for cooperation with a keeper and said second portion being a cam and forming a single tine for cooperation with a keeper and having an inclined side surface beginning at said latch body portion and continuing in a direction away from the body portion along substantially the entire height and length of the single tine.

3. A cam latch as set forth in claim 2 wherein said second elongated portion extends from said latch body portion for a greater distance than said first elongated portion.

4. A cam latch according to claim 2 wherein said first portion is forked.

5. A cam latch for a door control mechanism according to claim 4, in combination with a keeper that includes a base portion for attachment to a door frame or the like and first and second spaced portions extending outwardly from the base portion and constructed and arranged to be engaged by the projecting portions of the associated latch during latching of said pivoted doors, said first spaced portion being a post constructed to be straddled and engaged by said forked first projecting portion and said second spaced portion having a cam follower surface with a flange at its distal end for latching the cam, said surface being an inclined side wall adapted to engage said inclined tine surface and said flange including a latch member retaining wall extending laterally from the inclined side wall of said spaced portion and spaced from the base portion and constructed and arranged to engage only said single tine, said inclined side surface of the single tire and said inclined side wall serving to correct alignment of the door and the frame as the latch and keeper members interengage during operation of the mechanism and said first projecting latch member portion and said post serving to inhibit relative shifting of the door and the frame in the plane of the door when the latch and keeper members are interengaged.

6. A door control mechanism of the type used to latch pivoting flush-type double access doors in a closed position in associated upper and lower portions of a door frame comprising:

a pair of cam latch and keeper members, the cams of each and the keepers of each being similarly constructed but oppositely related, as the left and right hand are related;

said cam latch members each having a body portion for attachment to a pivoted shaft, said body portion having an axis of rotation coincident with that of the shaft and parallel to a pivotal axis of the doors; and first and second portions projecting in generally opposite directions transversely from said axis of rotation, said first portion being forked for engagement with said keeper member, and said second portion being a cam having a single tine for cooperation with said keeper member, curved and tapered from a first height at a proximal end to a second lesser height at a distal end, and having a cam surface inclined along the projecting length of the tire that extends substantially the full height of the projection;

said keeper members each having a base and first and second projections extending from said base, said first projection being a post constructed to be straddled and engaged by said forked first portion, and said second projection having an inclined cam follower surface for cooperation with said second latch projecting portion; and one of said pair of keeper members constructed to be mounted on an upper portion of the door frame, the other of said pair mounted on a lower portion of the door frame and facing oppositely from the one, and one of the cam latch members constructed to be mounted on one end of a pivoted shaft and the other constructed to be mounted on the other end, each oppositely facing so that each cam, when engaging its keeper can urge a door to which it is attached only in one vertical direction, which is opposite to that in which the other cam can urge the door.

* * * * *

UNITED STATES PATENT AND TRADEMARK OFFICE

CERTIFICATE OF CORRECTION

PATENT NO. : 4,844,523

DATED : July 4, 1989

INVENTOR(S) : John V. Pastva

It is certified that error appears in the above-identified patent and that said Letters Patent is hereby corrected as shown below:

Column 1, line 29, "3,484,128" should be --3,484,127-- ;

Column 6, line 20, "memer" should --member-- :

Column 6, line 55 "portion" should --position-- .

Signed and Sealed this

Seventh Day of August, 1990

*Attest:*

HARRY F. MANBECK, JR.

*Attesting Officer*

*Commissioner of Patents and Trademarks*